US008047162B2

(12) United States Patent
Maryamchik et al.

(10) Patent No.: US 8,047,162 B2
(45) Date of Patent: Nov. 1, 2011

(54) BLACK PLANT STEAM FURNACE INJECTION

(75) Inventors: Mikhail Maryamchik, Fairlawn, OH (US); Michael J. Szmania, Medina, OH (US); David J. Walker, Wadsworth, OH (US); Donald L. Wietzke, Carlsbad, CA (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 641 days.

(21) Appl. No.: 12/175,102

(22) Filed: Jul. 17, 2008

(65) Prior Publication Data

US 2009/0025658 A1 Jan. 29, 2009

Related U.S. Application Data

(60) Provisional application No. 60/952,390, filed on Jul. 27, 2007.

(51) Int. Cl.
*B01D 45/00* (2006.01)

(52) U.S. Cl. ..... 122/4 D; 122/442; 122/443; 55/434.2; 55/444

(58) Field of Classification Search ..... 122/4 D, 122/488, 489, 414, 415, 406.1, 438, 442, 122/443; 165/104.16; 55/444, 434.2, 442; 110/216, 245

See application file for complete search history.

(56) References Cited

U.S. PATENT DOCUMENTS

| | | | | |
|---|---|---|---|---|
| 4,437,867 | A * | 3/1984 | Lerner | 96/297 |
| 5,809,940 | A * | 9/1998 | James et al. | 122/4 D |
| 6,128,895 | A * | 10/2000 | Takahama et al. | 60/39.182 |
| 6,500,221 | B2 * | 12/2002 | Walker et al. | 55/444 |
| 6,619,041 | B2 * | 9/2003 | Marin et al. | 60/653 |
| 6,863,703 | B2 * | 3/2005 | Maryamchik et al. | 55/342.1 |
| 7,287,477 | B2 * | 10/2007 | Gounder | 110/345 |

* cited by examiner

*Primary Examiner* — Gregory A Wilson
(74) *Attorney, Agent, or Firm* — Eric Marich

(57) ABSTRACT

A system and method for quickly cooling and de-pressurizing a boiler arrangement in the event of a plant power loss, a.k.a. a black plant condition. A steam discharge system injects steam from the steam/water circuit into the furnace, thereby both cooling components of the boiler arrangement and reducing pressure in the steam/water circuit. This reduces or eliminates the additional cost associated with providing extra capacity in a steam drum and/or an independently powered boiler water pump. The system and method is particularly useful for quickly cooling the U-beams of a circulating fluidized bed (CFB) boiler during a black plant condition. In application to boiler arrangements with a selective non-catalytic reduction (SNCR) system employing steam as a carrier for a $NO_x$ reducing agent, the steam discharge system advantageously uses the discharge nozzles of the SNCR system to inject the steam into the furnace.

17 Claims, 4 Drawing Sheets

BLACK PLANT STEAM FURNACE INJECTION

CROSS-REFERENCE TO RELATED APPLICATION

Priority is claimed to U.S. provisional patent application Ser. No. 60/952,390, filed Jul. 27, 2007, the entire disclosure of which is incorporated herein by reference.

FIELD AND BACKGROUND OF INVENTION

The present invention relates, in general, to circulating fluidized bed (CFB) boiler arrangements and, more particularly, to a CFB boiler arrangement having a selective non-catalytic reduction (SNCR) system employed downstream of the CFB boiler furnace to achieve enhanced $NO_x$ reduction capability.

CFB boiler arrangements are known and used in the production of steam for industrial processes and/or electric power generation. See, for example, U.S. Pat. Nos. 5,799,593, 4,992,085, and 4,891,052 to Belin et al.; U.S. Pat. No. 5,809,940 to James et al.; U.S. Pat. Nos. 5,378,253 and 5,435,820 to Daum et al.; and U.S. Pat. No. 5,343,830 to Alexander et al. In a CFB boiler furnace, reacting and non-reacting solids are entrained within the furnace enclosure by the upward gas flow that carries solids to the exit at the upper portion of the furnace, where the solids are separated by impact type particle separators. The impact type particle separators are placed in staggered arrays to present a path which may be navigated by the gas stream, but not the entrained particles. The collected solids are returned to the bottom of the furnace. One CFB boiler arrangement uses a plurality of impact type particle separators (or concave impingement members or U-beams) at the furnace exit to separate particles from the flue gas. While these separators can have a variety of configurations, they are commonly referred to as U-beams because they most often have a U-shaped configuration in cross-section.

Impact type particle separators are generally placed at the furnace exit and typically are not cooled. They are placed at the furnace outlet to protect the downstream heating surfaces, such as secondary and primary superheater surfaces, from erosion by solid particles. Thus, the U-beams are exposed to the high temperatures of the flowing stream of flue gas/solids, and the materials used for the U-beams must be sufficiently temperature resistant to provide adequate support and resistance to damage.

Impact type particle separators which are cooled or supported off a cooled structure are known. See, for example, U.S. Pat. No. 6,322,603 B1 to Walker, U.S. Pat. No. 6,500,221 B1 to Walker et al., and U.S. Pat. No. 6,454,824 B1 to Maryamchik et al.

A known impact type separator CFB boiler arrangement offered by The Babcock & Wilcox Company, based on an entirely water-cooled setting, is shown in FIGS. 1, 2 and 2A. This arrangement provides a furnace 10 having a gas-tight enclosure 11 suitable for operating with a positive pressure in the furnace 10, and provides a gas flow path for flue gas 15. It has no high temperature refractory lined flues in the vicinity of the primary particle separator U-beams 32 or in-furnace U-beams 34 and therefore requires minimal building space and reduces furnace refractory maintenance. This construction is possible due to the use of an impact type primary solids separator (U-beams 32) integrated into the boiler enclosure 11.

Fuel and sorbent are fed to the CFB bed through the lower front wall of furnace 10. The ash and spent sorbent are removed through drain pipes in the floor. The solids collected by the U-beams 32, 34 and multi-cyclone dust collector are returned through the rear wall to the lower portion of furnace 10.

Primary air enters furnace 10 through the distributor plate and secondary air is injected at elevations approximately 6 and 12 feet (1.8 and 3.7 m) above the distributor plate through upper and lower overfire air headers.

The primary solids separation system, generally designated 30, includes staggered rows of U-shaped channel members, or U-beams 32, suspended from the boiler roof. Material striking the U-beams 32 is separated from the flue gas 15, flows down the U-channel and discharges from the bottom.

A circulating fluidized bed (CFB) boiler furnace has substantial thermal inertia, which is attributed to hot bed material and un-cooled parts of the solids separator at the furnace exit such as U-beams, hot refractory, etc. In case of plant power loss, a.k.a. a black plant condition, the Main Steam Stop Valve (MSV) typically closes to prevent a rapid steam/water side pressure reduction and water level drop in the boiler. The thermal inertia of the drum, tubes, headers and other boiler components will continue to promote steam generation lasting after the MSV closing. In order to prevent steam pressure buildup that would trigger a safety valve opening with a corresponding rapid water level drop in the boiler, and to provide cooling of superheater surface subjected to residual heat of the un-cooled parts of the boiler components, such as a CFB boiler provided with U-beam solids separator, a steam relief valve would open allowing steam to bleed through the steam side of the superheater into the atmosphere or to the steam user (e.g., when the steam is used for heating), typically in a controlled manner.

As in the case of an open MSV or safety valve, this steam bleed results in a lowering of the water level in the boiler circulation system. If the water level recedes below the furnace roof, it will result in portions of the tubes being un-cooled, and those un-cooled tubes which are exposed to the residual heat of the un-cooled parts of the solids separator may be damaged. In order to prevent this from happening, the boiler may be provided with sufficient steam drum capacity and/or an independently powered boiler water pump that would maintain a safe water level in the boiler. However, providing this extra capacity of the steam drum and/or an independently powered boiler water pump adds to the boiler cost.

The combination of low temperatures and staged combustion allows fluidized-bed boilers, such as CFB boiler systems, to operate with low NOx emissions. Further NOx reduction can be controlled to lower values through the use of a selective non-catalytic reduction (SNCR) system consisting of ammonia injection near the U-beam elevation. An ammonia-based SNCR system includes storage and handling equipment for the ammonia, equipment for mixing the ammonia with a carrier (such as compressed air, steam or water) and injection equipment. The injection system, a key component, consists of nozzles generally located at various elevations on the furnace walls to match the expected flue gas operating temperature.

For additional details of the design and operation of circulating fluidized bed boilers and SNCR systems, the reader is referred to Chapter 17 and pages 34-13 to 34-15 of *Steam/Its Generation and Use,* 41st Edition, The Babcock & Wilcox Company, Barberton, Ohio, U.S.A., © 2005.

SUMMARY OF INVENTION

The present invention is drawn to a system and method for reducing or eliminating the additional cost associated with providing extra capacity in the steam drum and/or an independently powered boiler water pump to a boiler arrangement, in the event of a black plant condition. This is achieved by discharging a steam bleed stream into the boiler furnace. The steam discharge would be conducted in a controlled manner. When steam is discharged into the furnace, its temperature (typically, within the range of 300 F to 750 F) is substantially lower than that of the un-cooled parts, e.g. of the solids separator (typically, 1400 F to 1700 F). Therefore, the steam discharge will accelerate their cooling down to the temperature level safe for the material of potentially un-cooled tubes (typically, 900 F to 1000 F) thus reducing or eliminating the need for extra capacity of the steam drum and/or an independently powered boiler water pump, also known as a dribble pump. The invention advantageously simultaneously both reduces boiler pressure and cools hot boiler components, such as U-beams and associated support structures.

Accordingly, one aspect of the invention is drawn to a steam discharge system for use with a circulating fluidized bed (CFB) boiler arrangement during a black plant condition. The CFB boiler arrangement includes a CFB furnace with a solids separator system and a steam/water circuit for circulating steam and water. The steam discharge system is comprised of means for transporting steam from the steam/water circuit, along with means, connected to the means for transporting steam, for injecting the transported steam into the furnace, thereby cooling the solids separator system and reducing pressure in the steam/water circuit. The means for injecting the transported steam into the furnace may include a steam injection header and a plurality of injection nozzles. A dribble pump may be connected to a steam drum in the steam/water circuit to maintain water flow to the steam drum, thereby offsetting steam lost from the steam/water circuit by injection into the furnace. Steam may be obtained from an attemperator inlet header or the steam drum, or at any other point in the steam path in the steam/water circuit and the means for transporting steam may include a steam supply line connected between the steam/water circuit and the means for injecting steam into the furnace. The means for transporting steam may also include a pressure reducing station connected to a steam supply line. When used, the steam supply line and pressure reducing station may be sized for about 5% of boiler maximum continuous rating (BMCR) steam flow.

In another aspect of the present invention, the steam discharge system may be applied to a CFB boiler arrangement equipped with a selective non-catalytic reduction (SNCR) system utilizing steam as a carrier for a NOx reducing agent, such as ammonia, with the discharge nozzles of the SNCR system provided and located so as to discharge the steam and ammonia into the furnace. According to the invention, these same SNCR system nozzles may thus be used for discharging the steam bleed into the furnace in case of a black plant condition. Accordingly another aspect/object of the invention is drawn to a steam discharge system for use during a black plant condition with a boiler arrangement having a selective non-catalytic reduction system that employs steam as a flowing carrier gas for a NOx reduction agent. The boiler arrangement includes a steam/water circuit with a steam drum and a circulating fluidized bed furnace with a solids separator system. The steam discharge system also includes means for stopping the flowing carrier gas and NOx reduction agent, and a steam supply line having a pressure reducing station therein for supplying steam from the steam/water circuit to the selective non-catalytic reduction system. The steam discharge system also includes means for discharging the steam supplied from the steam/water circuit through the selective non-catalytic reduction system into the furnace, thereby cooling the solids separator system. The steam supply line and pressure reducing station may be sized for about 5% of BMCR steam flow. The steam discharge system may also include a dribble pump connected to the steam drum to maintain water flow to the steam drum, thereby offsetting the loss of steam supplied from the steam/water circuit and discharged into the furnace.

Yet another aspect of the invention is drawn to a method of cooling the hot boiler components of a boiler arrangement during a black plant condition. The boiler arrangement includes a boiler enclosure defining a gas flow path for transporting flue gas during normal operation. The method includes the steps of providing a source of steam, and discharging the steam into the gas flow path during a black plant condition, thereby cooling the hot boiler components. Where the boiler arrangement includes an SNCR system having a plurality of SNCR injection nozzles which discharge a mixture of steam and ammonia into the gas flow path during normal operation, the method step of discharging the steam into the gas flow path may include discharging steam solely through SNCR injection nozzles. Where the boiler arrangement includes a CFB furnace having an impact type particle separator, the step of discharging the steam into the gas flow path during a black plant condition serves to cool the impact type particle separator. Where the boiler arrangement includes a CFB furnace having an impact type particle separator comprised of U-beams, the method may include the steps of monitoring the temperature of the U-beams and continuing the steam discharge step until the temperature of the U-beams is about 850°-900° F. The attemperator inlet header of a boiler arrangement may serve as the source of the steam, in which case the step of providing a source of steam includes transporting steam from the attemperator inlet header.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

The general purpose for black plant procedures and equipment is to allow the boiler pressure to decay and the boiler setting to cool down to stable conditions as quickly as practical, without allowing water level to drop below the furnace roof, following a black plant trip. The following provides general background information and outlines of how the present invention would be applied to deal with a black plant condition, and particularly as applied to a CFB boiler arrangement experiencing a black plant condition.

Figure 3:
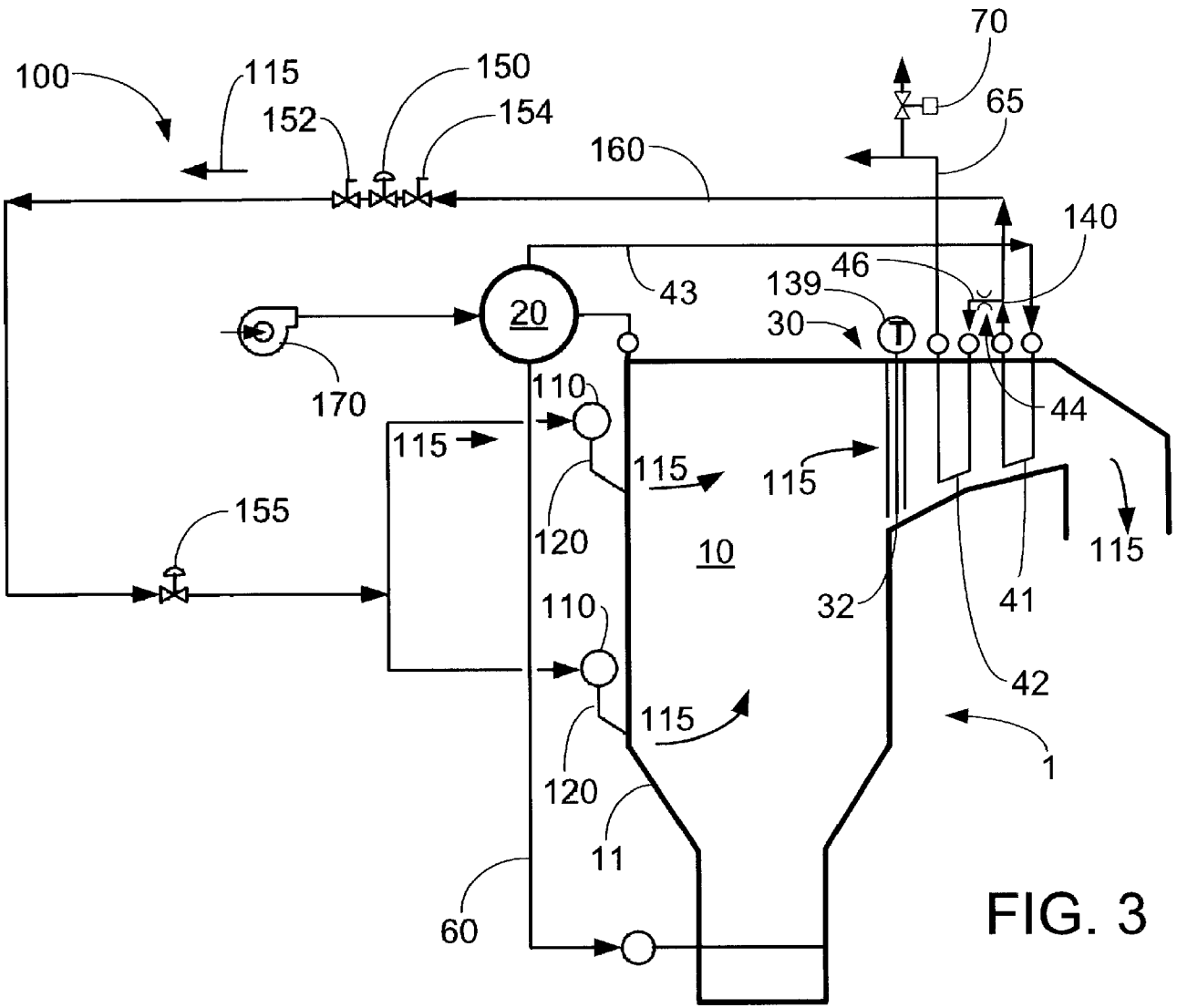
FIG. 3 is a schematic illustration of a CFB boiler arrangement according to the present invention.
Figure 4:
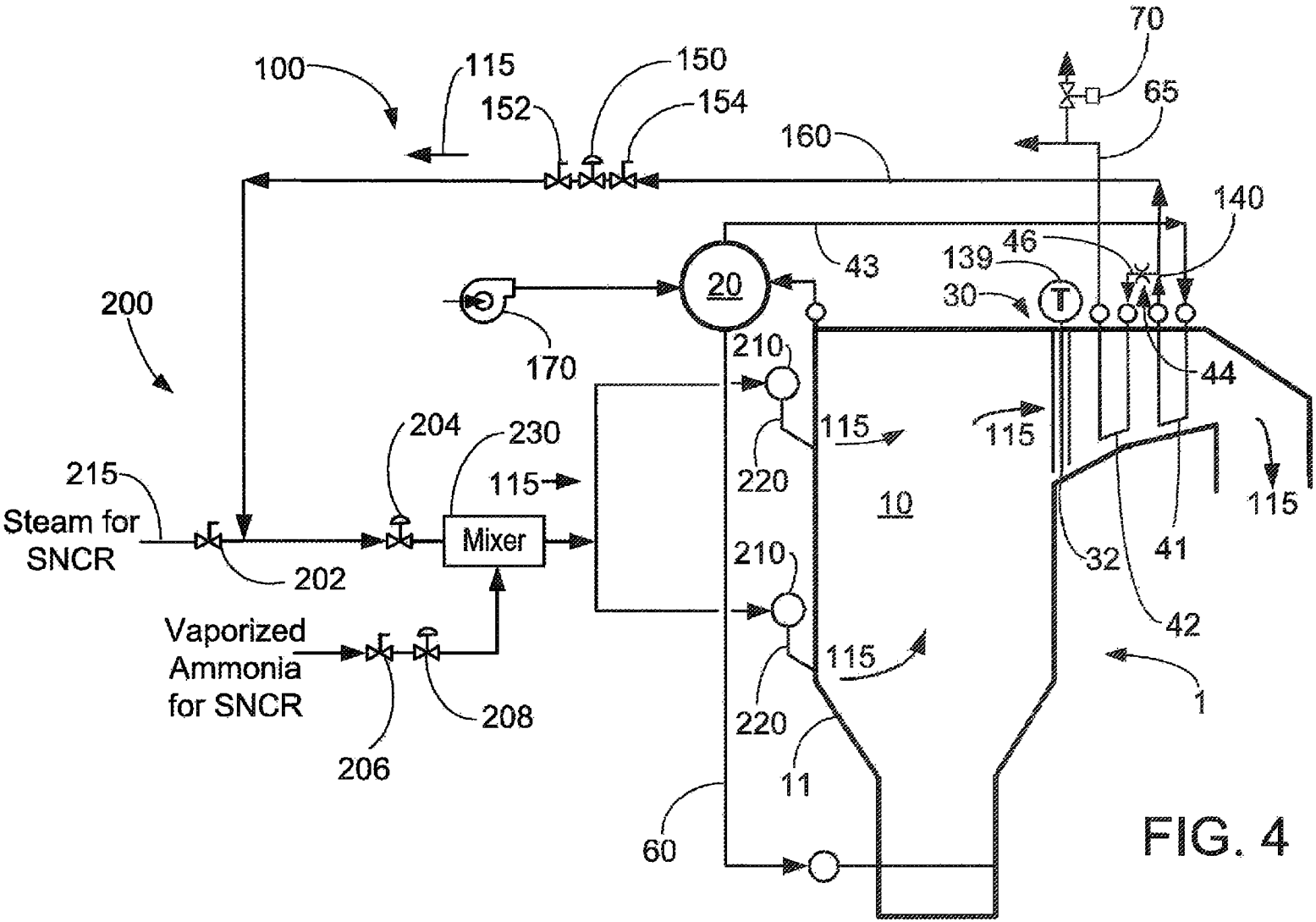
FIG. 4 is a schematic illustration of a CFB boiler arrangement according to a variation of the present invention, suitable for use in a boiler arrangement with an SNCR system.

Referring now to FIGS. 3 and 4, the U-beams are impact type separators which collect and recycle solids back to the furnace 10. The impact type separators serve to protect downstream heating surfaces, such as primary superheater 41, secondary superheater 42 and reheat surfaces from erosion. Attemperator 46 is an apparatus for reducing and controlling the temperature of a superheated fluid passing through it. This is accomplished by spraying high purity water 44 into an interconnecting steam pipe, usually between superheater stages 41, 42.

After a black plant trip, the furnace operation solids inventory of a CFB boiler arrangement 1 will generally collapse to the floor of the furnace 10 at the bed operating temperature just prior to trip. This inventory will continue to transfer heat to the lower walls of furnace 10 and generate steam for some time, even though the lower furnace refractory and the 'self insulation' by the boundary layer of the bed against the walls of furnace 10 tend to slow the heat transfer. Even with the lower steaming rate, with main steam stop valves failing closed at trip, the additional steam generation will tend to raise steam pressure and tend to reduce water level in drum 20 as that water becomes steam. Taken all together:

- the rising steam pressure will typically lead to lifting one or more of the safety valves on main steam outlet 65 and drum 20;
- additional steam production from the slumped bed and initial collapse of steam voids in circulating water will tend to quickly reduce water level; and
- water level tends to be reduced even more quickly should safety valve(s) lift and allow the collapse of circulating water steam voids more readily.

Figure 1:
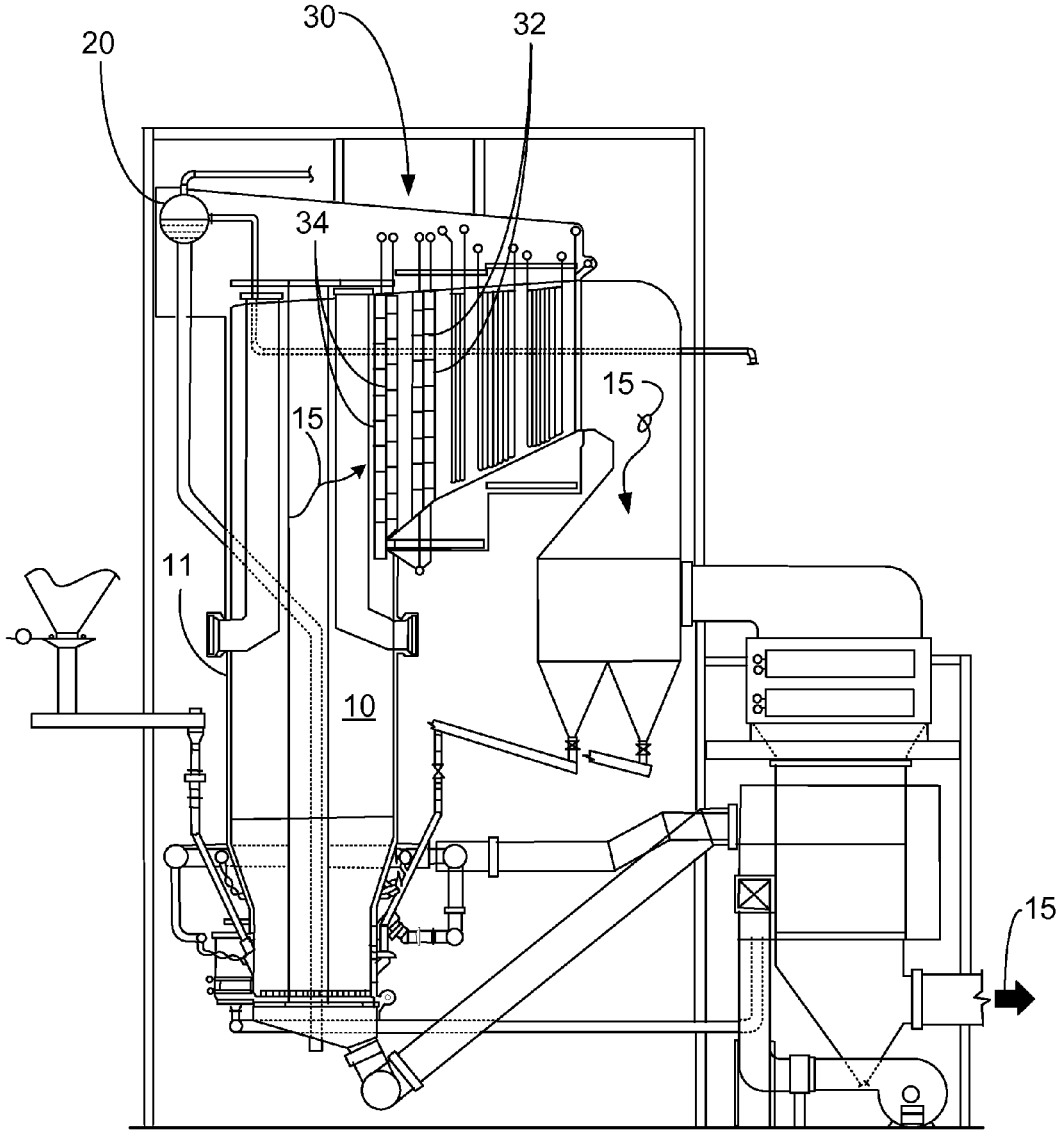
FIG. 1 PRIOR ART
FIG. 1 is a schematic illustration of a known CFB boiler arrangement.
Figure 2A:
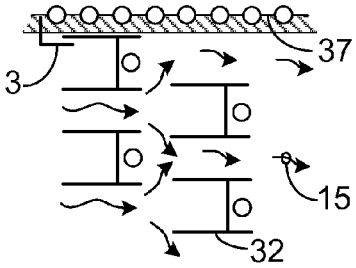
FIG. 2A PRIOR ART
FIGS. 2 and 2A are schematic illustrations of the upper portion of the CFB boiler of FIG. 1.
Figure 2:
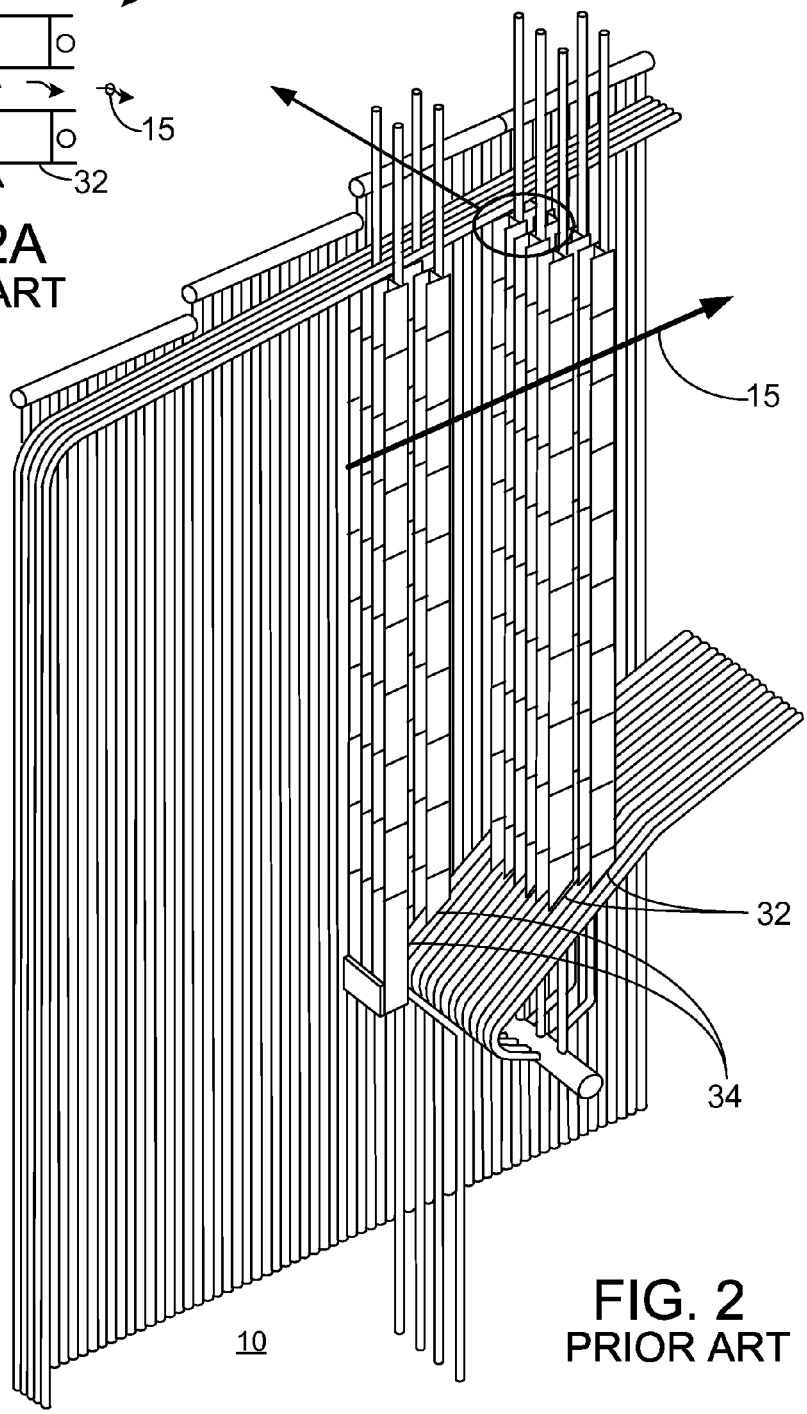
FIG. 2 PRIOR ART

For the CFB furnace 10, upon a black plant trip the U-beams 32 represent a significant thermal storage mass which will continue to radiate heat to surrounding areas of the boiler setting for some period of time. Specifically, the water-cooled U-beam/rear wall support tubes 37 (see FIG. 2A) will continue to receive heat from the U-beams 32 at elevated temperature similar to normal operation. As in normal operation, so long as these tubes contain water, they will maintain acceptable temperatures and stress values. Should the water level fall below the roof, some portion of these tubes may only have steam cooling, and the tube metal temperature would rise. Even though low alloy steel tubes have been used for the U-beam and rear wall support tubes 37, shown as SW membrane panel in FIG. 2A (with ability to maintain normal operation stress levels to temperatures over normal working temperature), loss of water in the tubes while the U-beams 32 are still near their normal operating temperature could result in tube temperature where the normal operation stress in the tube exceeds allowable stress at that temperature.

To counter the conditions that lead to rapid water loss to below the furnace roof, the following actions or method steps are employed:

1) controlled venting of steam 115 both into the furnace 10 and to the atmosphere as required to suppress pressure rise and help reduce chance of lifting safety valves.

2) initial venting of approximately 5-10% boiler maximum continuous rating (BMCR) steam flow through a steam discharge/injection system, generally designated 100. Steam discharge system 100 includes a steam bleed line 160 which transports steam 115 from a steam source located in the boiler steam path of steam/water circuit 60, such as steam drum 20 or preferably from attemperator inlet header 140, through a high pressure reducing station 150 and steam injection headers 110 to a plurality of injection nozzles 120, which discharge steam 115 into furnace 10. This steam injection will help cool the U-beams 32. Pressure reducing station 150 preferably is equipped with automated isolation valves 152, 154. For boiler arrangements equipped with an SNCR system 200 employing steam as a carrier gas for ammonia for delivery to the furnace 10 through one or more levels of SNCR injection nozzles or ports 220, steam discharge system 100 advantageously incorporates existing SNCR steam injection headers 210 and SNCR injection nozzles or ports 220. The number and size of injection ports used will depend upon desired steam venting capability.

3) additional venting of an additional 5-10% BMCR steam flow through a power (pneumatic) operated ball valve 70 on the main steam outlet lead 65.

4) operation of back up 'dribble pump' 170 to maintain water flow to the drum 20 to offset water lost through venting of steam 115 produced by the slumped bed inventory and other thermal energy stored in the mass of the boiler setting.

Projected sequence of operations on Black Plant Trip include:

A) A distributed control system (DCS) will continue to run on an uninterruptible power supply (UPS).

B) For valves that need to be automatically maneuvered after trip, UPS will be available for solenoid operation (if not DCS powered) and adequate air receiver capacity will be available to allow operation.

C) It is currently assumed that the turbine stop valves (or a main steam stop valve) will close and stop flow of main steam out of the boiler. This will tend to make the pressure rise in drum 20.

D) Forced draft and ID fan dampers will 'fail in place' on black plant trip and allow for a gas flow path through the unit.

E) Should an SNCR system 200 be in operation, automatically and immediately close the 'normal' low pressure supply steam supply valve 202 and maneuver system valves 150 to accept steam from bleed point off the attemperator inlet header 140. Automatically maneuver the discharge valves (not shown) for the SNCR vaporization/mixing skid 230 so that both levels of SNCR injectors 220 are available to inject steam 115 into the furnace 10.

F) Automatically, and immediately on trip and closure of main steam stop valves (and coordinated with closure of normal SNCR steam supply valve 202 when SNCR 200 is in operation), begin bleed of a high pressure steam stream 115 from the attemperator inlet header 140 through steam line bleed line 160 to the high pressure reducing station 150 and the SNCR mixing and injection ports 220 into the furnace 10. This steam bleed/pressure reduction equipment 160, 150 will preferably be sized for approximately 5% BMCR steam flow.

G) Monitor pressure rise at the main steam outlet lead 65, as is known in the art, and preferably open power operated vent 70 if pressure continues to rise and approaches the lift pressure of the secondary superheater (SSH) outlet safety valve by about 25-30 psig.

H) Operator(s) commence to valve in and start the dribble pump 170. Whether direct driven, or motor driven by power from back-up generator or auxiliary power feed to the plant; the plan should preferably be for the pump 170 to be capable to supply water to drum 20 in no more than 5 to 7 minutes. The dribble pump 170 should preferably be capable of supplying the drum 20 with 10% or more of maximum continuous rating (MCR) feedwater flow at normal operation pressure. Operation of dribble pump 170 should preferably be planned for a minimum of 45 minutes from the time it is started and water flow to the boiler is initiated.

I) Monitor steam pressure and drum level, as is known in the art. As needed, open the power operated vent valve 70 to accommodate more pressure relief.

J) Monitor U-Beam temperature. To the extent that steam pressure has started falling away from lift pressure for any safety valves, stop steam venting to furnace 10 when the temperature measured by temperature sensor 139 in U-beam area thermocouple grid has cooled to 850°-900° F.

K) Continue operation of dribble pump 170 until not supported by deaerator storage level or the level of drum 20 is stable at normal water level (NWL) or within 3-4" below NWL.

L) Restore unit to normal operation configuration when power supply to the plant is re-established.

While specific embodiments of the invention have been shown and described in detail to illustrate the application of the principles of the invention, it is understood that the invention may be embodied otherwise without departing from such principles. For example, the present invention may be applied to new boiler or steam generator construction, or to the replacement, repair or modification of existing boilers or steam generators. In some embodiments of the invention, certain features of the invention may sometimes be used to advantage without a corresponding use of the other features. Accordingly, all such changes and embodiments properly fall within the scope of the following claims.

We claim:

1. In a circulating fluidized bed boiler arrangement with a solids separator system and a steam/water circuit for circulating steam and water, a steam discharge system for use during a black plant condition, the steam discharge system comprising:

means for transporting steam from the steam/water circuit; and means, connected to the means for transporting steam, for injecting the transported steam into the furnace, thereby cooling the solids separator system and reducing pressure in the steam/water circuit.

2. The steam discharge system of claim 1, wherein the means for injecting the transported steam into the furnace further comprises a steam injection header and a plurality of injection nozzles.

3. The steam discharge system of claim 1, wherein the means for injecting the transported steam into the furnace further comprises steam injection headers and injection nozzles of an SNCR system connected to the furnace.

4. The steam discharge system of claim 1, wherein the steam/water circuit includes a steam drum and the steam discharge system further comprises a dribble pump connected to the steam drum to maintain water flow to the steam drum, thereby offsetting steam lost from the steam/water circuit by injection into the furnace.

5. The steam discharge system of claim 1, wherein the boiler arrangement further comprises an attemperator inlet header, and the means for transporting steam comprises a steam supply line connected between the attemperator inlet header and the means for injecting steam into the furnace.

6. The steam discharge system of claim 5, further comprising a pressure reducing station connected to the steam supply line.

7. The steam discharge system of claim 6, wherein the steam supply line and pressure reducing station are sized for about 5% of BMCR steam flow.

8. In a boiler arrangement having a steam/water circuit with a steam drum, a circulating fluidized bed furnace with a solids separator system, and a selective non-catalytic reduction system that employs steam as a flowing carrier gas for a $NO_x$ reduction agent, a steam discharge system for use during a black plant condition, the steam discharge system comprising:

means for stopping the flowing carrier gas and $NO_x$ reduction agent;

a steam supply line having a pressure reducing station therein for supplying steam from the steam/water circuit to the selective non-catalytic reduction system; and means for discharging the steam supplied from the steam/water circuit through the selective non-catalytic reduction system into the furnace, thereby cooling the solids separator system.

9. The steam discharge system of claim 8, wherein the steam supply line and pressure reducing station are sized for about 5% of BMCR steam flow.

10. The steam discharge system of claim 8, wherein the steam discharge system further comprises a dribble pump connected to the steam drum to maintain water flow to the steam drum, thereby offsetting the loss of steam supplied from the steam/water circuit and discharged into the furnace.

11. The steam discharge system of claim 8, wherein the boiler arrangement further comprises an attemperator inlet header, and the steam supply line connects the attemperator inlet header to the selective non-catalytic reduction system.

12. A method of cooling the hot boiler components of a boiler arrangement during a black plant condition, the boiler arrangement having a boiler enclosure defining a gas flow path for transporting flue gas during normal operation and an SNCR system having a plurality of SNCR injection nozzles which discharge a mixture of steam and ammonia into the gas flow path during normal operation, the method comprising:

providing a source of steam; and discharging the steam into the gas flow path during a black plant condition, thereby cooling the hot boiler components and wherein the step of discharging the steam into the gas flow path comprises discharging solely steam into the boiler through SNCR injection nozzles.

13. The method of claim 12, wherein the boiler arrangement further comprises a CFB furnace having an impact type particle separator with U-beams and the method further comprises the steps of monitoring the temperature of the U-beams and continuing the steam discharge step until the temperature of the U-beams is about 850°-900° F.

14. The method of claim 13, wherein the boiler arrangement further comprises an attemperator inlet header and wherein the step of providing a source of steam comprises transporting steam from the attemperator inlet header.

15. A method of cooling the hot boiler components of a boiler arrangement during a black plant condition, the boiler arrangement having a boiler enclosure defining a gas flow path for transporting flue gas during normal operation and an attemperator inlet header, the method comprising:

providing a source of steam; and discharging the steam into the gas flow path during a black plant condition, thereby cooling the hot boiler components and wherein the step of providing a source of steam comprises transporting steam from the attemperator inlet header.

16. The method of claim 15, wherein the boiler arrangement further comprises a CFB furnace having an impact type particle separator, and wherein the step of discharging the steam into the gas flow path during a black plant condition, thereby cools the impact type particle separator.

17. The method of claim 16, wherein the impact type particle separator comprises U-beams and the method further comprises the steps of monitoring the temperature of the U-beams and continuing the steam discharge step until the temperature of the U-beams is about 850°-900° F.

* * * * *